United States Patent [19]

Biemans

[11] Patent Number: 4,461,409

[45] Date of Patent: Jul. 24, 1984

[54] SEWING MACHINE NEEDLE THREADER

[76] Inventor: Arnoldus Biemans, Mathenesserlaan 432, 3023 Hg Rotterdam, Netherlands

[21] Appl. No.: 502,173

[22] Filed: Jun. 8, 1983

[51] Int. Cl.[3] ..... D05B 87/02

[52] U.S. Cl. ..... 223/99; 112/225

[58] Field of Search ..... 112/224, 225; 223/99

[56] References Cited

U.S. PATENT DOCUMENTS

| | | | |
|---|---|---|---|
| 524,896 | 8/1894 | Goldman | 112/225 |
| 2,169,124 | 8/1939 | Holland | 112/225 |
| 2,476,872 | 7/1949 | Jarno | 112/225 |
| 2,525,034 | 10/1950 | Jarno | 112/225 |
| 2,679,959 | 6/1954 | Von Ullisperger et al. | 223/99 |
| 3,000,545 | 9/1961 | Ullisperger | 112/225 X |

FOREIGN PATENT DOCUMENTS

| | | |
|---|---|---|
| 488887 | 1/1954 | Italy . |

*Primary Examiner*—Werner H. Schroeder

*Assistant Examiner*—Andrew M. Falik

*Attorney, Agent, or Firm*—Body, Vickers & Daniels

[57] ABSTRACT

A threader for a mounted sewing machine needle having an eye adjacent the pointed lower end thereof includes a base plate adapted to be received beneath the foot of the machine, and a housing providing a positioning recess for aligning the needle threader with the sewing machine needle eye. The housing supports a pair of reciprocable thread pusher members at right angles to one another, and when the device is aligned with the needle eye, the first pusher member is displaceable from a retracted to an extended position to push a strand of thread through the needle eye from one side thereof to the other. When the first pusher member is returned to the retracted position, the second thread pusher member is displaceable from a retracted to an extended position to engage a loop of thread on the other side of the needle eye and to displace the thread laterally of the needle to a position where it can be easily grasped by the user's fingers.

20 Claims, 9 Drawing Figures

SEWING MACHINE NEEDLE THREADER

BACKGROUND OF THE INVENTION

This invention relates to the art of sewing machine accessories and, more particularly, to a device for threading a mounted sewing machine needle.

It is of course well known that the eye of a sewing machine needle is adjacent the pointed lower end of the needle. In most sewing machines, mounting of the needle positions the eye for the axis thereof to extend in the direction from the front to the rear of the machine. As is further well known, sewing machines include a foot pad which is supported for reciprocable displacement toward and away from the sewing surface of the machine and beneath which material is moved as it is being sewed. The foot pad is supported by a vertical post disposed behind the sewing machine needle in the direction from the front toward the rear of the machine, and the foot pad includes laterally spaced apart foot plates which extend forwardly of the needle on laterally opposite sides thereof.

Heretofore, sewing machine needles have been manually threaded by introducing an end of the thread through the needle eye in the direction toward the foot pad support post therebehind, and then grasping the free end of the thread between the forefinger and thumb and pulling the thread laterally of the needle to complete the threading operation. In addition to the difficulty of introducing the free end of the thread through the needle eye, as the result of such factors as the size of the eye, the user's vision, and the difficulty of holding the thread steady, the space between the back side of the needle and the support post for the foot is rather small, whereby it is difficult to grasp the free end of the thread once it is pushed through the eye. Adding to the latter difficulty is the fact that the thread must be held by the fingers of one hand on the front side of the needle to assure against withdrawal of the free end from the eye while the fingers of the second hand are manipulated to grasp and pull the free end laterally of the needle.

SUMMARY OF THE INVENTION

In accordance with the present invention, a sewing machine needle threading device is provided which advantageously eliminates the foregoing manual threading procedure. More particularly in this respect, the needle threading device includes a first thread pusher member adapted to be aligned with the needle eye and to push a strand of thread through the needle eye from one side thereof to the other so as to provide a loop of thread on the other side of the needle. When the first pusher member is withdrawn, a second thread pusher member is displaceable laterally of the needle adjacent the other side thereof and is adapted to engage the loop and displace the thread laterally of the needle and foot pad support post to a location where it is easily grasped between the thumb and forefinger to complete the threading operation.

In the preferred embodiment, the needle threading device includes needle and thread positioning recesses. The needle positioning recess enables the first thread pusher member to be laterally and vertically aligned with the needle eye, and the thread positioning recess enables positioning a strand of thread in the path of the first pusher member, whereby a minimum amount of time and effort is required to position the device for use and to initiate a threading operation. Further in accordance with the preferred embodiment, the first and second thread pusher members are supported in the housing including a base plate which is adapted to be received between the foot pad and sewing surface of the sewing machine so as to stabilize the threading device during operation thereof.

It is accordingly an outstanding object of the present invention to provide a sewing machine needle threading device which is structurally separate from the sewing machine and which is operable to push a strand of thread through a needle eye and then displace the pushed through portion of the thread laterally of the needle to facilitate completion of the threading operation.

Another object of the present invention is the provision of a sewing machine needle threading device of the foregoing character including a first thread pusher member positionable in alignment with the needle eye and operable to push a thread portion through the eye from one side thereof to the other so as to form a loop of thread adjacent the other side of the needle eye, and a second thread pusher member adjacent the other side of the needle and displaceable to engage the loop and displace the thread portion laterally of the needle.

Still another object is the provision of a sewing machine needle threading device of the foregoing character which includes a positioning recess for aligning the first thread pusher member with the needle eye.

A further object is the provision of a sewing machine needle threading device of the foregoing character which includes a recess for positioning a strand of thread in the path of movement of the first pusher member.

Yet a further object is the provision of a sewing machine needle threading device of the foregoing character including a base plate portion received between the foot pad and sewing surface of a sewing machine to stabilize the device during a needle threading operation.

Yet another object is the provision of a sewing machine needle threading device which is structurally simple and economical to manufacture and which is easy to use and efficient in connection with achieving threading of a mounted sewing machine needle.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF THE PREFERRED EMBODIMENT

Referring now in greater detail to the drawings wherein the showings are for the purpose of illustrating a preferred embodiment of the invention only, and not for the purpose of limiting the invention, a sewing machine needle threading device according to the present invention includes a first housing 10 extending upwardly from a base plate 12 which is adapted to rest on the underlying sewing surface S of a sewing machine. Preferably, base plate 12 has an end 14 adapted to underly foot pad F of a sewing machine so as to stabilize the threading device during a threading operation. As is well known, foot pad F is mounted on the lower end of a support post P which provides for the foot pad to be elevated and lowered relative to sewing surface S. As is further well known, the foot pad F includes a pair of laterally spaced apart legs F extending forwardly with respect to the front to rear direction of the sewing machine and which spaced apart legs accommodate vertical reciprocation of the sewing machine needle N during sewing machine operation. As is also well known, sewing needle N has an eye E adjacent the pointed lower end of the needle, and the upper end of the needle is mounted in a vertically reciprocable needle support, not shown, by which the needle is reciprocated between positions above and below sewing surface S during a sewing operation.

Figure 1:
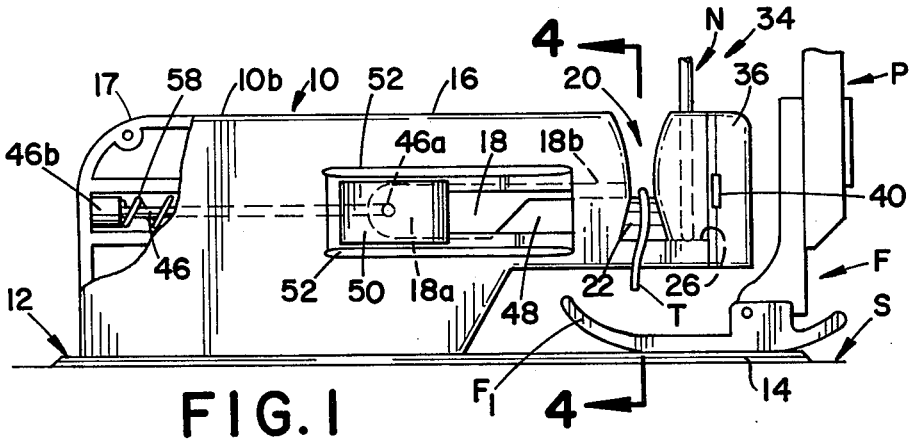
FIG. 1 is a side elevation view of a needle threading device according to the present invention and showing the device associated with mounted needle and foot pad components of a sewing machine.

When the needle threading device is positioned for use in threading needle N, as shown in FIG. 1, housing 10 extends in the direction from the front toward the rear of the sewing machine and includes first and second ends 16 and 17, end 16 being spaced above end 14 of base plate 12 and overlying foot pad F. The axis of needle eye E also extends in the direction between the front and rear of the sewing machine and, as described more fully hereinafter, housing 10 supports a reciprocable first thread pusher member 18 which is operable to push a portion of a strand of thread through the needle eye in the direction from the front toward the rear of the machine. End 16 of housing 10 includes a vertically and laterally open thread positioning recess 20 having a bottom wall 22 for supporting a strand of thread T prior to a needle threading operation. End 16 further includes a vertically and longitudinally open needle positioning recess 24 spaced forward from recess 20 and having a bottom wall 26. Bottom wall 26 is adapted to be engaged by the pointed lower end of needle N to vertically align needle eye E with an opening 28 in housing portion 10. Opening 28 is adjacent the upper end of bottom wall 22 of thread positioning recess 20 and, as will be explained in greater detail hereinafter, the forward end of thread pusher member 18 is displaced through opening 28 during the needle threading operation to push thread T through needle eye E. With further regard to needle positioning recess 24, the latter includes laterally spaced apart arcuate walls 30 extending upwardly from bottom wall 26 and converging in the direction toward thread positioning recess 20 to provide a vertically open narrow passageway 32 opening into the thread positioning passageway and having a lateral width less than the diameter of needle N. Passageway 32 is a thread release or escape passageway which serves the purpose set forth hereinafter, and the converging relationship between walls 30 provides for laterally aligning thread pusher member 18 with the axis of needle eye E.

The needle threading device further includes a second housing 34 extending laterally from end 16 of housing 10 and having inner and outer ends 36 and 37, inner end 36 being laterally adjacent needle positioning recess 24. As will be explained more fully hereinafter, housing 34 supports a second thread pusher member 38 for lateral reciprocation transverse to the axis of needle eye E. Thread pusher member 38 is adapted to be displaced through an opening 40 in end 36 of housing 34 and is supported for such displacement to be along a path spaced from the needle in the direction toward the rear of the sewing machine and at a vertical elevation intersecting the axis of the needle eye.

Figure 2:
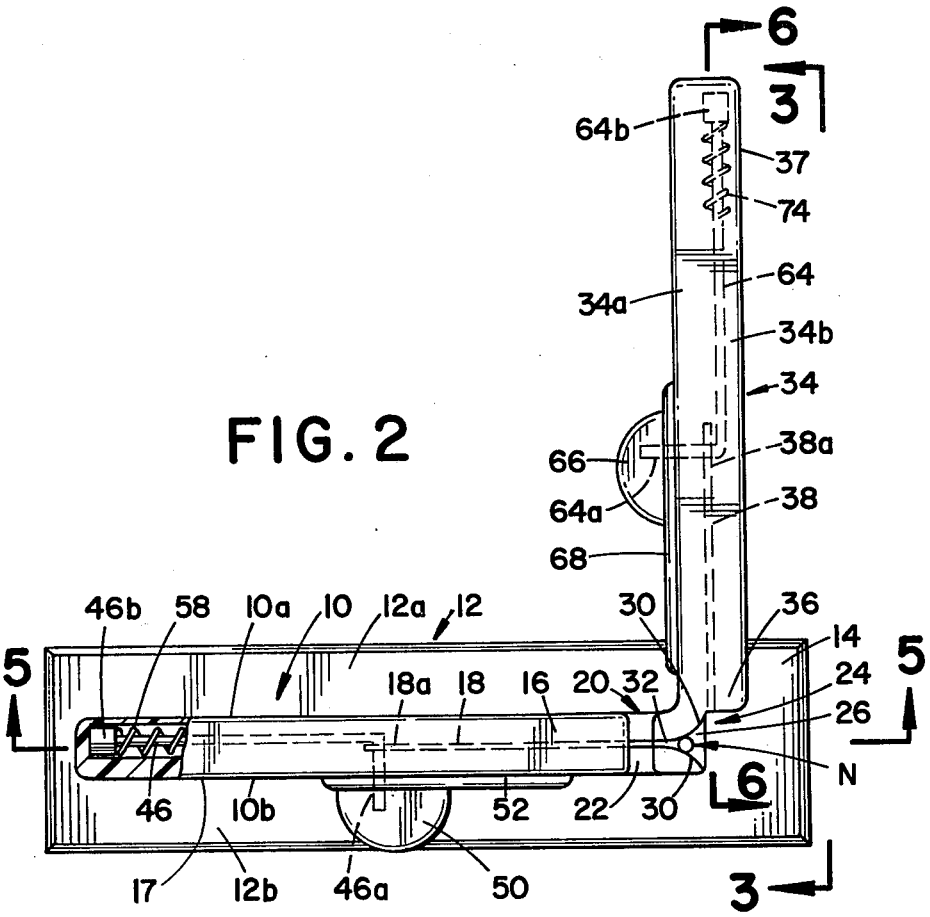
FIG. 2 is a plan view of the needle threading device.
Figure 4:
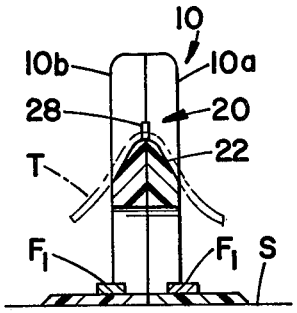
FIG. 4 is a sectional elevational view taken along line 4—4 in FIG. 1.
Figure 5:
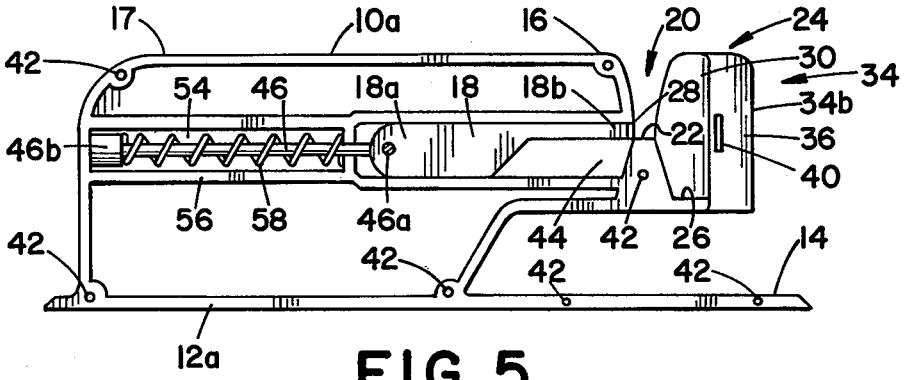
FIG. 5 is a sectional elevation view of the device taken along line 5—5 in FIG. 2.

Housings 10 and 34 and base plate 12 are preferably constructed of suitable plastic material and, in the embodiment shown and as best seen in FIGS. 2, 4 and 5 of the drawing, housing 10 is defined by portions **10*a* and 10*b* each integral with a corresponding portion 12*a* and 12*b* of base plate 12, and housing 34 includes a first portion 34*a* integral with portion 10*a*, and a second portion 34*b*. The housing portions or halves are suitably interconnected to provide the corresponding housing. For example, one of the housing portions can be provided with recesses 42 as shown for portions 10*a* and 34*b* in FIGS. 5 and 6, and portions 10*b* and 34*b*** can be provided with corresponding projections received in the recesses. The halves are securely held together either by tight interengagement between the recesses and projections, or by the latter together with adhesive bonding of the halves.

With reference to FIGS. 1, 2 and 5, it will be seen that the inside of housing portion **10*a* includes a horizontally extending guide track or recess 44 for pusher member 18 which is an elongated thin metal member having an inner end 18*a* and a vertically narrow outer end 18*b* adapted to be displaced from housing portion 10 through opening 28. Inner end 18*a* of the pusher member is apertured to receive an actuating rod member 46 having an end 46*a* extending through the aperture in the threader member and outwardly through a window 48 in housing portion 10*b* to receive a push knob 50. Window 48 provides for horizontal displacement of push knob 50 and rod end 46*a*, and guidance of push knob 50 is provided by horizontally extending guide rails 52 integral with housing portion 10*b*. Actuator rod 46 extends from end 18*a* of pusher member 18 in the direction toward end 17 of housing 10 and is disposed in recess 54 defined by a boxlike support component 56 integral with housing portion 10*a*. End 46*b* of the actuator rod is enlarged, and a biasing spring 58 surrounds the actuator rod and is longitudinally captured between end 46*b* of the latter and the end wall of recess 54 adjacent end 18*a* of pusher member 18. Accordingly, it will be appreciated that displacement of push knob 50 from left to right in FIG. 1 is operable to displace pusher member 18 along a linear path in the direction between ends 16 and 17 of housing 10 and between the retracted position shown and an extended position relative to housing 10. Upon release of push knob 50, spring 58 is operable to displace the pusher member back to the retracted position thereof. While only portion 10*a* of housing 10 is shown in FIG. 5 with respect to the interior thereof, it will be appreciated that portion 10*b* is appropriately contoured on the interior thereof to support and guide pusher member 18, actuator rod 46 and spring 58**.

Figure 3:
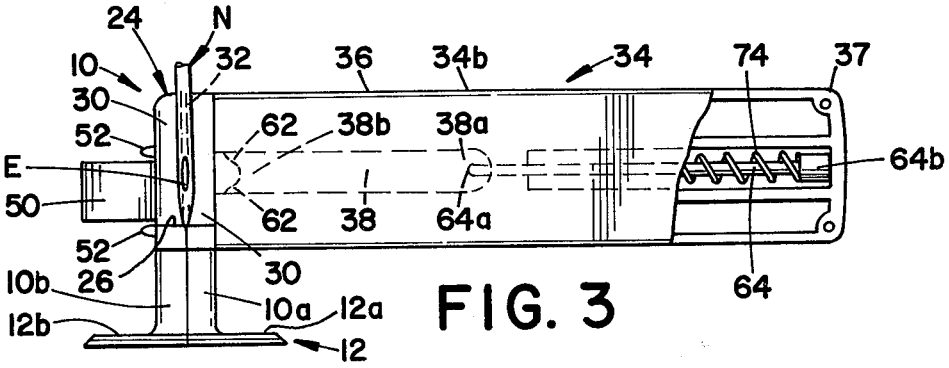
FIG. 3 is a front elevation view looking in the direction of line 3—3 in FIG. 2.
Figure 6:
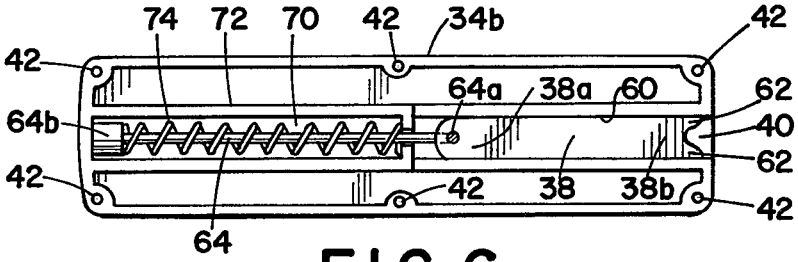
FIG. 6 is a sectional elevation view of the device taken along line 6—6 in FIG. 2.
Figure 7:
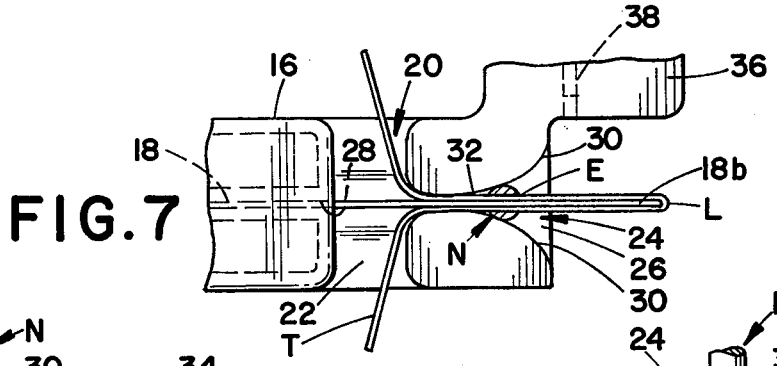
FIG. 7 is an enlarged plan view of a portion of the device showing the sewing machine needle in cross-section through the eye thereof and operation of the first thread pusher member; and, FIGS. 8 and 8A are enlarged elevation views of a portion of the device and showing operation of the second thread pusher member.
Figure 8:
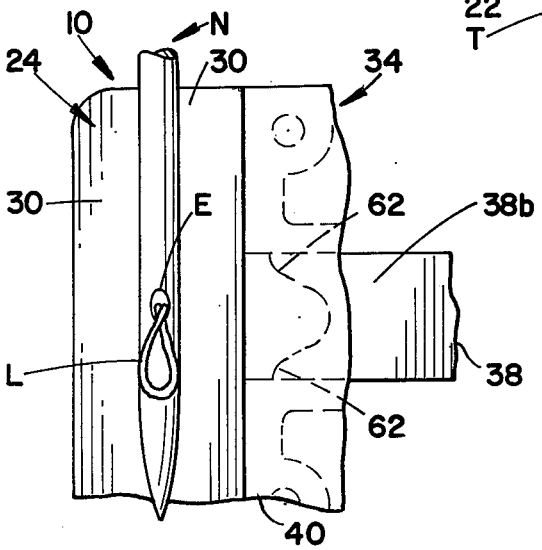
Figure 8A:
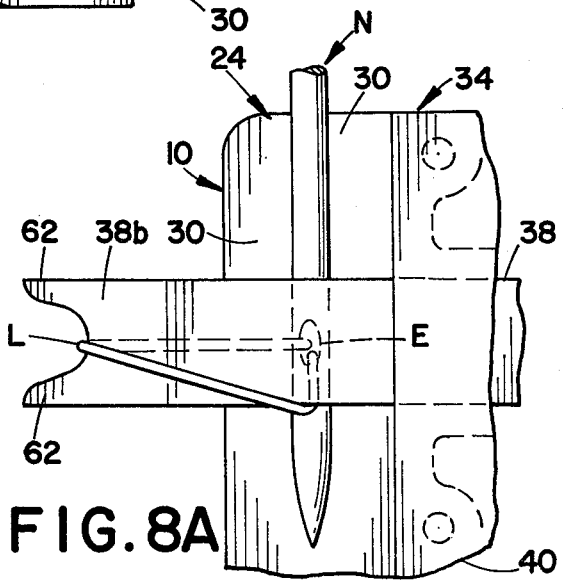

With reference to FIGS. 2, 3 and 6 of the drawing, it will be seen that housing 34 supports thread pusher member 38 much in the same manner as housing 10 supports pusher member 18. In this respect, pusher member 38 is a thin metal component slidably supported in a guide track or recess 60 provided in housing portion **34*b* and the pusher member has an apertured inner end 38*a* and an arcuately concave outer end 38*b* providing vertically spaced apart fingers 62. An actuator rod 64 has an end 64*a* extending through the aperture in end 38*a* of pusher member 38 and outwardly through housing portion 34*a* to receive a push knob 66. While not visible in the drawings, it will be appreciated that housing portion 34*a* includes a longitudinally extending window similar to window 48 in housing portion 10*b* and which facilitates displacement of actuator rod 64 toward and away from end 36 of housing 34. Guidance for push knob 66 during such displacement is provided by upper and lower horizontally extending guide rails 68, the upper one of which is visible in FIG. 2. Actuator rod 64 has an enlarged outer end 64*b* and is reciprocably supported in a recess 70 provided in a box-like component 72 provided in housing half 34*b*. A biasing spring 74 surrounds actuator rod 64 between end 46*b* thereof and the end wall of recess 70 adjacent end 38*a* of pusher member 38. Accordingly, it will be appreciated that when push knob 66 is displaced toward housing 10 from the position shown in FIG. 3, pusher member 38 is displaced along a linear path in the direction between ends 36 and 37 of housing 34 and from its retracted position to an extended position extending across housing 10 and for the purpose set forth hereinafter. When push knob 66 is released, spring 74 biases thread pusher member 38** back to its retracted position.

With the foreging structure in mind, it is believed that operation of the device in achieving the threading of a sewing machine needle will be understood from the following description with reference to FIGS. 1, 2, 3, 7, 8 and 8A of the drawing. To initiate a needle threading operation, end 14 of base plate 12 is positioned beneath foot pad F of the sewing machine for the latter to stabilize the threading device. The threading device is then manipulated relative to needle N to position the needle in engagement with walls 30 of needle positioning recess 24, and needle N is lowered through operation of the sewing machine hand wheel to bring the pointed lower end thereof into engagement with bottom wall 26 of the positioning recess. This laterally and vertically aligns needle eye E with end **18*b* of thread pusher member 18. Thread T is then draped across bottom wall 22 of thread positioning recess 20, and push knob 50 is displaced from left to right in FIG. 1 to displace end 18*b* from the retracted position shown in FIG. 1 to the extended position shown in FIG. 7. During such displacement, end 18*b* engages thread T and pushes the latter through needle eye E to form a thread loop L which extends beyond the lateral path of thread pusher member 38. When loop L has been thus formed, push knob 50 is released and thread pusher member 18 is displaced back to its retracted position by biasing spring 58. When threaded member 18 is withdrawn from engagement with thread loop L, the inherent nature of the thread material will cause the latter to twist relative to needle eye E for the loop L to be open laterally toward pusher member 38 and to be in alignment with either the upper or lower one of the fingers 62 on end 38*b* thereof. Then, by displacing push knob 66 toward housing portion 10, which is from right to left in FIG. 3, pusher member 38 is displaced from the retracted position shown in FIGS. 2 and 8 to the extended position shown in FIG. 8A wherein end 38*b* is positioned laterally outwardly of housing 10 in the direction away from housing 34. During such movement of pusher member 38, loop L in engaged by one of the fingers 62 on end 38*b* whereby the loop is displaced laterally from needle N and foot pad F to a position where it can be easily grasped between a person's thumb and forefinger and pulled to complete the threading operation. Once the thread is grasped in the foregoing manner, push knob 66 is released, whereby pusher member 38 is returned to the retracted position thereof by spring 74. It will be appreciated of course that one end of thread T is free and that the other end is wound on a spool, and that the free end is pulled through the needle eye in completing the threading operation. The threaded needle is then adapted to be separated from the threading device by pulling the latter away from the needle, whereupon the spool connected end of the thread is adapted to separate from the needle threading device by displacement through the vertically open escape or release passage 32** behind the needle.

While particular emphasis has been placed herein on a specific structure and operation of the preferred embodiment, it will be appreciated that many embodiments of the invention can be made and that many changes can be made in the embodiment herein illustrated and described without departing from the principles of the invention. Accordingly, it is to be distinctly understood that the foregoing descriptive matter is to be interpreted merely as illustrative of the present invention and not as a limitation.

Having thus described the invention, it is claimed:

1. A needle threading device for a sewing machine having a sewing surface, vertically positionable foot pad means above said surface, and a vertically reciprocable sewing needle having a pointed lower end and an eye adjacent said end comprising, housing means, first thread pusher means supported in said housing means for displacement along a first path between retracted and extended positions relative to said housing means, means on said housing means engageable with said needle to position said eye in alignment with said first path for said first pusher means to extend through said eye from one side of said needle to the other when said first pusher means is displaced from said retracted to said extended position thereof, second thread pusher means supported in said housing means for displacement along a second path between retracted and extended positions relative to said housing means, said second path extending laterally of said first path and being on said other side of said needle, and means to displace each said first and second thread pusher means between said retracted and extended positions thereof.

2. A needle threading device according to claim 1, wherein said housing means includes means to position a thread across said first path between said first pusher means and said one side of said needle when said first pusher means is in said retracted position.

3. A needle threading device according to claim 2, and a thread release passageway between said thread positioning means and said means engagable with said needle to position said eye.

4. A needle threading device according to claim 1, and base plate means underlying said housing means and including a plate portion receivable between said sewing surface and said foot pad means.

5. A needle threading device according to claim 1, wherein said means to displace each said first and second thread pusher means includes corresponding manually displaceable knob and actuator means for displacing said thread pusher means from said retracted to said extended position, and corresponding biasing means biasing said thread pusher means from said extended to said retracted position.

6. A needle threading device according to claim 1, wherein said means on said housing means engagable with said needle to position said eye includes a vertical needle positioning recess having converging side walls engaging said needle laterally of said eye, and having a bottom wall engaged by said lower end of said needle.

7. A needle threading device according to claim 6, wherein said housing means includes means to position a thread across said first path between said first pusher means and said one side of said needle when said first pusher means is in said retracted position.

8. A needle threading device according to claim 7, and a thread release passageway between said thread positioning means and said needle positioning recess.

9. A needle threading device according to claim 7, wherein said means to position a thread includes a vertically and laterally open thread positioning recess in said housing means spaced from said needle positioning recess in the direction from said other toward said one side of said needle.

10. A needle threading device according to claim 6, and base plate means underlying said housing means and including a plate portion receivable between said sewing surface and said foot pad means.

11. A needle threading device according to claim 10, wherein said housing means includes means to position a thread across said first path between said first pusher means and said one side of said needle when said first pusher means is in said retracted position.

12. A needle threading device according to claim 11, wherein said means to position a thread includes a vertically and laterally open thread positioning recess in said housing means spaced from said needle positioning recess in the direction from said other toward said one side of said needle.

13. A needle threading device according to claim 12, and a thread release passageway between the inner ends of said walls of said needle positioning recess and said thread positioning recess.

14. A needle threading device according to claim 13, wherein said means to displace each said first and second thread pusher means includes corresponding manually displaceable knob and actuator means for displacing said thread pusher means from said retracted to said extended position, and corresponding biasing means biasing said thread pusher means from said extended to said retracted position.

15. A needle threading device for a sewing machine having a sewing surface, vertically positionable foot pad means above said surface, and a vertically reciprocable sewing needle having a pointed lower end and an eye adjacent said end comprising, base plate means having an end receivable under said foot pad means, housing means including a first housing on said plate means and having a first end spaced above said foot pad means and a second end spaced from said first end, a first reciprocable thread pusher member supported in said first housing for displacement between retracted and extended positions along a first linear path between said first and second ends, said first housing including a needle positioning recess in said first end for positioning said needle eye in alignment with said first path, said first housing further including a thread positioning recess spaced from said needle positioning recess in the direction toward said second end, said first pusher member in said extended position having a portion extending through said thread positioning recess and said needle positioning recess and an outer end spaced outwardly of said needle positioning recess, means to displace said first pusher member between said retracted and extended positions thereof, said housing means further including a second housing extending laterally from said first end of said first housing and having an inner end adjacent said first end and an outer end spaced from said inner end, a second reciprocable thread pusher member supported in said second housing between said inner and outer ends thereof for displacement between retracted and extended positions along a second linear path transverse to and intersecting said first path, said second path being spaced outwardly of said needle positioning recess, said second thread pusher member in said extended position thereof having an outer end laterally spaced from said first path in the direction of extension of said second thread pusher member, and means to displace said second thread pusher member between said retracted and extended positions thereof.

16. A needle threading device according to claim 15, wherein said means to displace each said first and second thread pusher member includes corresponding manually displaceable knob and actuator means for displacing said thread pusher member from said retracted to said extended position, and corresponding biasing means biasing said thread pusher member from said extended to said retracted position.

17. A needle threading device according to claim 15, and a thread release passageway in said first housing between said needle positioning recess and said thread positioning recess.

18. A needle threading device according to claim 15, wherein said needle positioning recess has laterally spaced apart side walls converging in the direction from said first end toward said second end of said first housing, said side walls having inner ends engaging said needle laterally of said eye, and said recess having a bottom wall engaged by said lower end of said needle.

19. A needle threading device according to claim 18, and a thread release passageway in said first housing portion between said inner ends of said side walls and said thread positioning recess.

20. A needle threading device according to claim 19, wherein said means to displace each said first and second thread pusher member includes corresponding mutually displaceable knob and actuator means for displacing said thread pusher member from said retracted to said extended position, and corresponding biasing means biasing said thread pusher member from said extended to said retracted position.

* * * * *